US005564896A

United States Patent [19]

Beeck et al.

[11] Patent Number: 5,564,896

[45] Date of Patent: Oct. 15, 1996

[54] METHOD AND APPARATUS FOR SHAFT SEALING AND FOR COOLING ON THE EXHAUST-GAS SIDE OF AN AXIAL-FLOW GAS TURBINE

[75] Inventors: Alexander Beeck, Endingen; Eduard Brühwiler, Turgi, both of Switzerland

[73] Assignee: ABB Management AG, Baden, Switzerland

[21] Appl. No.: 510,777

[22] Filed: Aug. 3, 1995

[30] Foreign Application Priority Data

Oct. 1, 1994 [DE] Germany ..... 44 35 322.7

[51] Int. Cl.[6] ..... F01D 25/18

[52] U.S. Cl. ..... 415/175; 415/112

[58] Field of Search ..... 415/111, 112, 415/175, 176

[56] References Cited

U.S. PATENT DOCUMENTS

| | | | |
|---|---|---|---|
| 2,463,898 | 3/1949 | Moore | 415/112 |
| 2,763,462 | 9/1956 | McDowall et al. | 415/175 |
| 4,086,759 | 5/1978 | Karstensen et al. | 415/112 |
| 4,217,755 | 8/1980 | Williams | 415/175 |
| 4,451,200 | 5/1984 | Libertini et al. . | |
| 4,542,623 | 9/1985 | Hovan et al. | 415/176 |
| 4,561,246 | 12/1985 | Hovan | 415/176 |

FOREIGN PATENT DOCUMENTS

| | | | |
|---|---|---|---|
| 1258330 | 3/1961 | France | 415/112 |
| 1069428 | 6/1958 | Germany . | |
| 2008209 | 9/1970 | Germany . | |
| 2043480 | 4/1971 | Germany . | |
| 2408839 | 8/1974 | Germany . | |
| 3447740 | 7/1985 | Germany . | |
| 1041712 | 9/1983 | U.S.S.R. | 415/176 |

*Primary Examiner*—Edward K. Look
*Assistant Examiner*—Mark Sgantzos
*Attorney, Agent, or Firm*—Burns, Doane, Swecker & Mathis

[57] ABSTRACT

In a method and an apparatus for shaft sealing and for cooling on the exhaust-gas side of a thermal turbomachine, in particular an axial-flow gas turbine, in which the outlet-side bearing arrangement of the turbine rotor is made inside the exhaust-gas casing construction, and labyrinth seals and a gland are used for the sealing, barrier air having a higher pressure than the pressure of the exhaust gas in the exhaust-gas duct being directed for the shaft sealing into the gland and then into the exhaust-gas duct, and the rotor cooling air being extracted from a compressor stage and being fed via a pipeline through the exhaust-gas-side shaft end into the rotor, a portion of the rotor cooling-air leakage is diverted after some of the labyrinth seals and is used as barrier air. In addition, ambient air is introduced as cooling air into the bearing space, is uniformly distributed at the periphery via the gland separately from the barrier air, is partly used through cooling ducts for specifically cooling the supporting structure and is transported to the outside through passages in the exhaust-gas diffuser.

6 Claims, 5 Drawing Sheets

METHOD AND APPARATUS FOR SHAFT SEALING AND FOR COOLING ON THE EXHAUST-GAS SIDE OF AN AXIAL-FLOW GAS TURBINE

BACKGROUND OF THE INVENTION

1. Field of the Invention

The invention relates to a method and an apparatus for shaft sealing and for cooling on the exhaust-gas side of a thermal turbomachine, in particular an axial-flow gas turbine.

2. Discussion of Background

It is known that thermal turbomachines, in particular axial-flow gas turbines, essentially consist of the bladed rotor and the blade carrier, which is equipped with guide blades and hung in the turbine casing. Adjoining the turbine casing is the exhaust-gas casing, which in modern machines is flanged to the turbine casing and essentially consists of a hub-side annular inner part and an annular outer part which define the exhaust-gas diffuser. The inner part and the outer part are connected to one another by a plurality of radial flow ribs arranged uniformly over the periphery. The outlet-side bearing arrangement of the turbine rotor is disposed in the hollow space inside the inner part, that is, inside the diffuser construction itself.

Shaft seals (labyrinth seals, gland) are present for the noncontact sealing of the leadthroughs of the rotor through the exhaust-gas casing and for reducing the leakage to a suitable proportion.

In order to prevent hot exhaust gases from being able to penetrate into the bearing space, compressor air has hitherto been extracted from a certain stage, directed via a separate line to the exhaust-gas casing and fed as barrier air directly into the gland on the exhaust-gas side. A portion of the air escapes through the seal into the bearing space, the rest flows along the shaft disk into the hot-gas duct.

If a compressor having one or more variable guide blades is used in a gas turbine and if these guide blades are closed by a certain amount in the partial-load range, this results in a lower pressure at the extraction point of the barrier air relative to the pressure during full-load operation. Therefore, so that there is sufficient barrier-air pressure in each operating state, either air has to be extracted at a high stage in which there is always sufficient pressure or a changeover has to be made between different stages.

The extraction of the air at a high stage has the disadvantage that highly compressed air is "consumed" at full load without power output, which has an adverse effect on the efficiency of the gas turbine. On the other hand, if a changeover is made between different stages, more extraction points at the compressor and changeover valves are necessary, so that the costs increase.

If cooling air has to be introduced through the exhaust-gas-side shaft end into the rotor, the rotor cooling air is also extracted from a certain compressor stage in addition to the barrier air and is fed via a special pipeline into the rotor. The transition of pipeline/rotor is here sealed off with labyrinth seals. The labyrinth leakage air passes into the surroundings of the bearing and leads to heating-up of the bearing space. This is undesirable, since the bearing temperature is limited because of the devices present, the bearing oil and the possibility of an inspection.

Apart from the leakage of barrier air and rotor cooling air, the bearing space is also heated up by the heat flow from the exhaust-gas stream through the insulation or the supporting structure. In most machines, the bearing space is cooled by natural convection. It is also known to cool the bearing space by cooling air which enters through openings in the exhaust-gas diffuser and leaves through the gap between lining and rib of the exhaust-gas casing. In this solution, the supporting structure of the exhaust-gas casing has no uniform temperature at the periphery, which disadvantageously leads to thermal stressing occurring and/or to the bearing no longer being concentric.

SUMMARY OF THE INVENTION

Accordingly, one object of the invention, in attempting to avoid all these disadvantages, is to provide a novel barrier-air and cooling-air system on the exhaust-gas side in a thermal turbomachine, in particular an axial-flow gas turbine, which barrier-air and cooling-air system, with low fabrication and/or operating costs, prevents the ingress of the exhaust gas into the bearing space and admits as little air leakage as possible into the bearing space and with which the bearing-space temperature can be kept sufficiently low in a relatively simple manner and in which the supporting structure of the exhaust-gas casing has a uniform temperature at the periphery.

According to the invention, this is achieved in a method of shaft sealing between rotating shaft and exhaust-gas casing as well as of cooling the rotor and the bearing space on the exhaust-gas side of a thermal turbomachine, in particular an axial-flow gas turbine, in which the outlet-side bearing arrangement of the turbine shaft is made inside the exhaust-gas casing construction, and labyrinth seals and a gland are used for the sealing, barrier air having a higher pressure than the pressure of the exhaust gas in the exhaust-gas duct being directed for the shaft sealing into the gland and then into the exhaust-gas duct, and in which the rotor cooling air is extracted from a compressor stage and is fed via a pipeline through the exhaust-gas-side shaft end into the rotor, by a portion of the rotor cooling-air leakage being diverted after some of the labyrinth seals and being used as barrier air, and by ambient air being introduced as cooling air into the bearing space, which ambient air is uniformly distributed at the periphery via the gland and is transported to the outside through passages in the exhaust-gas diffuser.

According to the invention, this is achieved in an apparatus for carrying out the aforesaid method when the labyrinth seals at the transition from the rotor cooling-air line to the exhaust-gas-side end of the cooled rotor are divided and an intermediate tap having a pipeline, going to the gland, for the barrier air is arranged at the dividing point, when a further pipeline ending at the gland for ambient air acting as cooling air is arranged in the bearing space, the gland being divided into two concentric annular spaces for the barrier air and for the cooling air, and the bearing space being fed with cooling air from the annular cooling-air space via bores, and when the bearing space is subdivided in the top part by means of a hood and in the bottom part by means of an oil drip plate.

The advantages of the invention can be seen, inter alia, in the fact that a separate extraction point in the compressor for the barrier air and therefore a separate barrier-air feed are no longer necessary, that the leakage-air quantities passing into the bearing space are minimal, and that uniform cooling at the periphery for the supporting structure, the bearing and the oil wiper is achieved, so that the efficiency of the plant is increased.

It is especially convenient when the barrier-air quantity and the barrier-air pressure are set to an optimum value by changing the number of labyrinths and the respective gap sizes of the labyrinths, since the leakage air entering the bearing space can thereby be kept at a low level and thus no undesirable heating-up of the bearing space takes place.

Furthermore, it is advantageous when axially running cooling ducts are arranged between the supporting structure and the insulation in the inner part of the exhaust-gas casing along the flow ribs, preferably on either side at the foot of the flow ribs, which cooling ducts are connected via bores at their turbine-side inlet part to the annular cooling-air duct of the gland and at their outlet part to the bearing space, the cooling air from the annular cooling-air duct flowing through the said ducts. Through the specific use of the cooling air in the ducts, air is saved and large heat transfer coefficients are achieved. There are no flow obstructions and therefore a constant temperature is achieved at the periphery of the inner casing structure.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings of a single-shaft axial-flow gas turbine, wherein.

Only the elements essential for understanding the invention are shown. Elements of the plant which are not shown are, for example, the inlet parts of the gas turbine as well as the complete compressor part. The direction of flow of the working media is designated by arrows.

DESCRIPTION OF THE PREFERRED EMBODIMENTS

Figure 1:
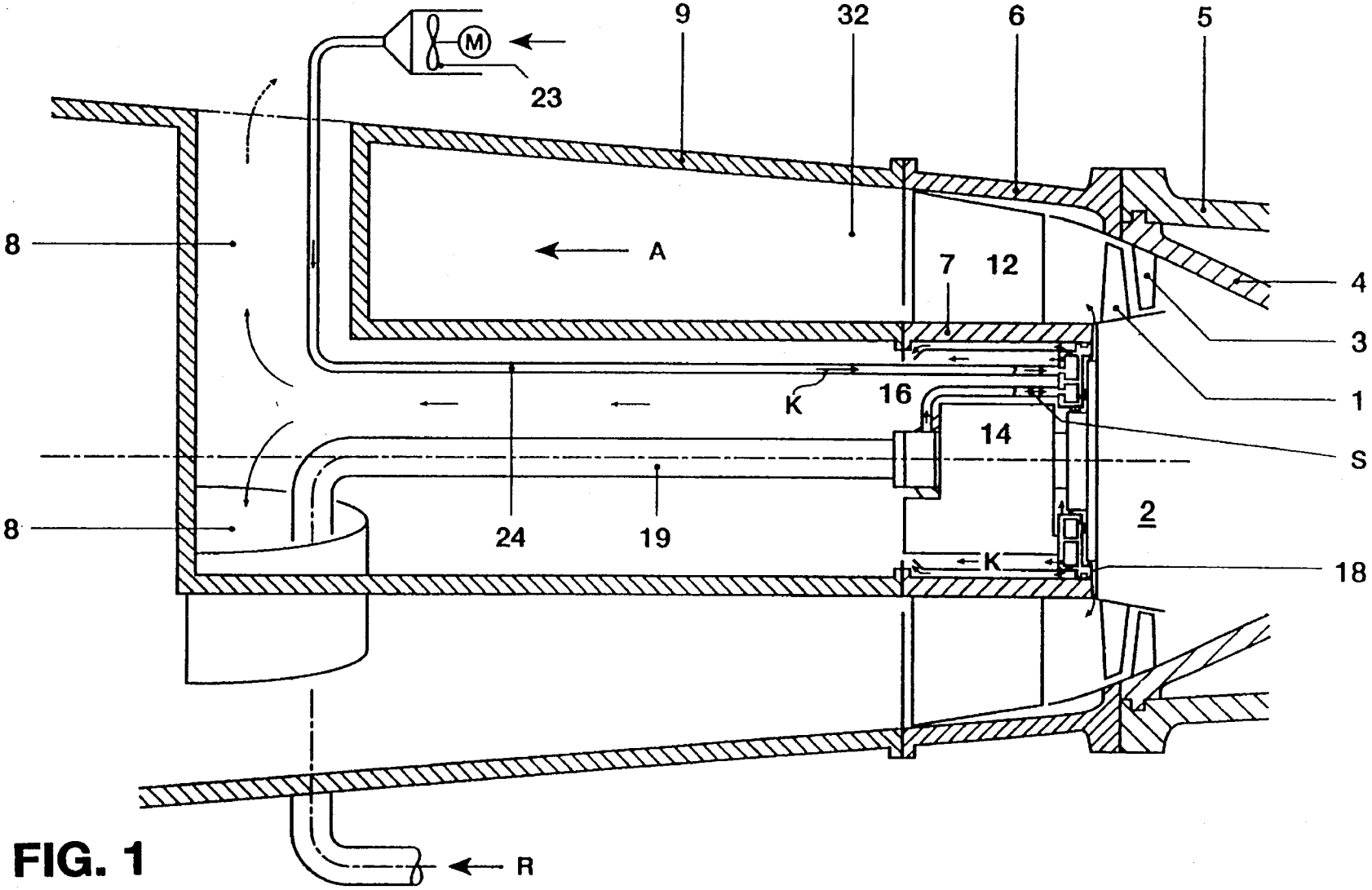
FIG. 1 shows a longitudinal section of the exhaust-gas tract of the gas turbine (overview)

Referring now to the drawings, wherein like reference numerals designate identical or corresponding parts throughout the several views, the invention is explained in more detail below with reference to exemplory embodiments and FIGS. 1 to 6, in which FIG. 1 shows as an overview a partial longitudinal section of a single-shaft, axial-flow gas turbine, of which the exhaust-gas side and the last stage of the turbine are shown.

Figure 2:
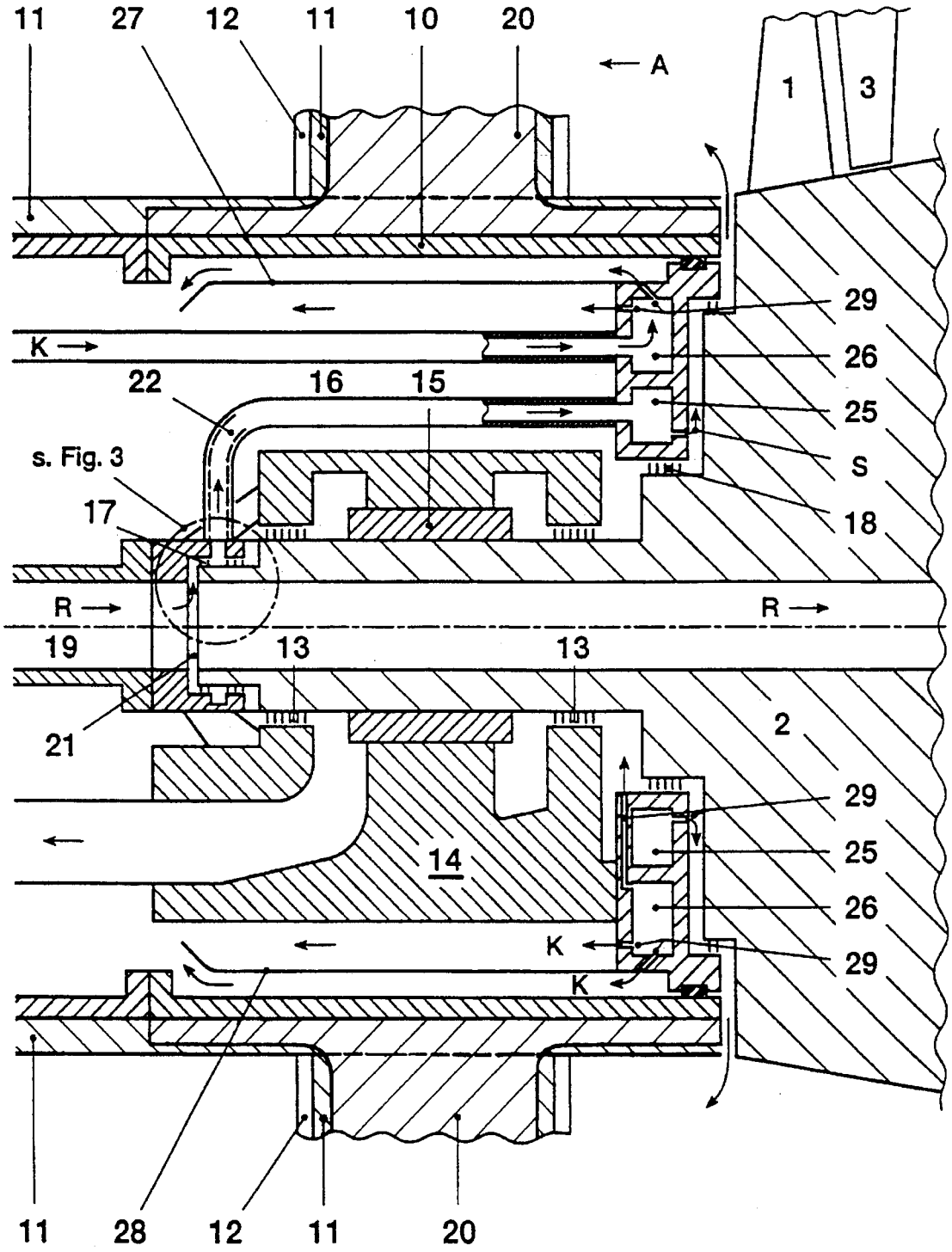
FIG. 2 shows a partial longitudinal section of the bearing area in the exhaust-gas tract of the gas turbine.
Figure 3:
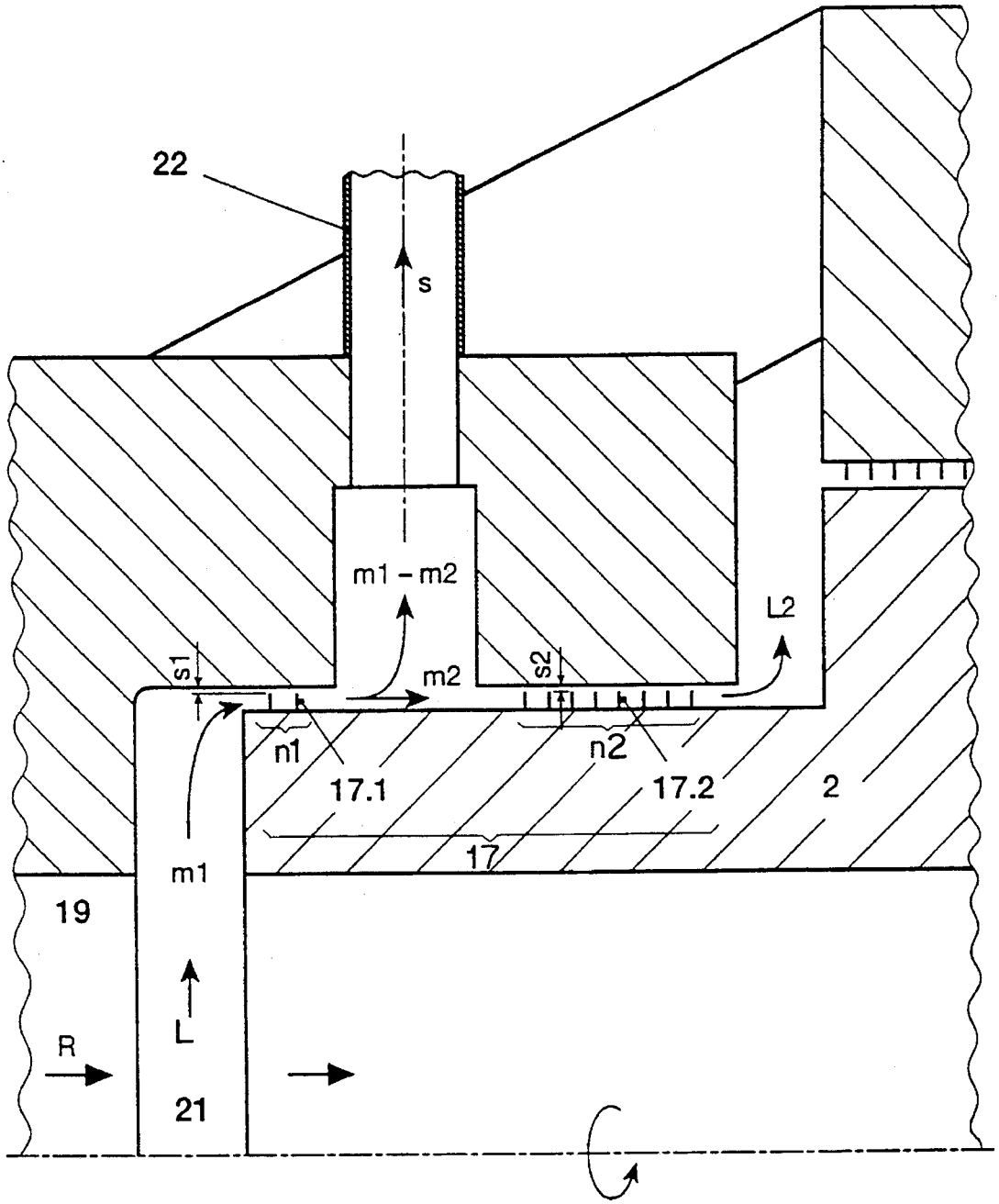
FIG. 3 shows an enlarged detail from FIG. 2 in the area of the labyrinth/rotor cooling air to rotor.

For the sake of more clearly recognizing the details, the bearing area in the exhaust-gas tract is shown in partial longitudinal section in FIG. 2 and the area of the labyrinth is shown enlarged in FIG. 3.

According to FIG. 1, the axial-flow gas turbine essentially consists of the rotor 2 which is equipped with moving blades 1 and of the blade carrier 4 which is equipped with guide blades 3 and is hung in the turbine casing 5. Flanged to the turbine casing 5 is the exhaust-gas casing 6, in which a plurality of flow ribs 12 distributed uniformly over the periphery are arranged. FIG. 2 reveals that the flow ribs 12 encase the supporting ribs 20, which are surrounded with an insulation 11. The exhaust-gas diffuser 9 is flanged to the exhaust-gas casing 6.

The outlet-side bearing arrangement of the rotor 2 (bearing housing 14, bearing 15) is arranged inside the exhaust-gas casing construction. Extending between the bearing housing 14 and the annular inner part 7 of the exhaust-gas casing 6 is the bearing space 16, which is sealed off on the turbine side from the exhaust-gas duct 32 via the gland 18 and from the rotor cooling air via labyrinth seals 17.

To cool the rotor 2, rotor cooling air R is extracted from the compressor (not shown here) and, via a pipeline 19, which, coming from the compressor, leads through one of the passages 8 located at the end of the exhaust-gas tract and extends in the area of the extended machine axis up to the exhaust-gas-side shaft end, is fed through the exhaust-gas-side shaft end into the rotor 2. A leakage L of this air arises in the gap 21 between the pipeline 19 and the rotating rotor 2, and all this leakage L, according to the prior art, escapes into the bearing space 16 and passes into the surroundings of the bearing 15. This point is normally sealed off with labyrinth seals 17.

FIG. 3 shows that, according to the invention, the labyrinth 17 is now subdivided into a labyrinth 17.1 having n1 sealing strips and a gap width s1 and into a labyrinth 17.2 having n2 sealing strips and a gap width s2. A pipeline 22 for the barrier air S is arranged between the two labyrinths 17.1 and 17.2, which pipeline 22 leads past the bearing housing 14 to the gland 18. Thus a portion of the rotor cooling-air leakage L is used as barrier air S. So that the barrier air S has just the requisite pressure, it is extracted after some of the seals. The leakage-air quantity over the remaining labyrinths is reduced by this extraction, so that only a minimum air loss and thus a minimum loss of efficiency occur and the surroundings of the bearing space are heated up only slightly.

The invention is of course not restricted to the arrangement of a single barrier-air line 22. Two or even more pipelines of this type can be advantageously arranged at any possible points around the bearing housing.

Figure 4:
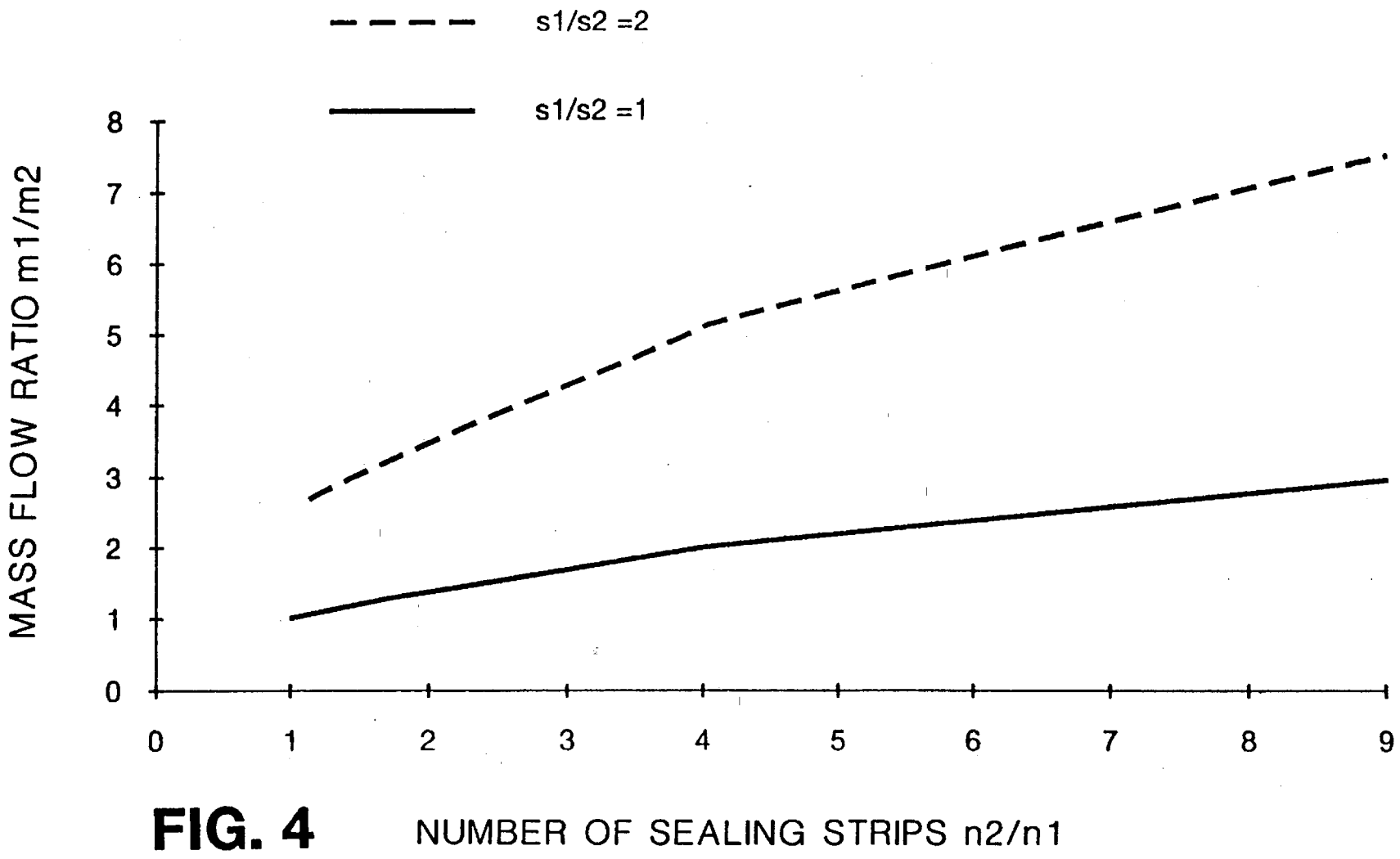
FIG. 4 shows the dependence of the mass-flow ratios in a divided labyrinth having an intermediate tap on the ratio of the number of sealing-strips and the ratio of the labyrinth gap size.

FIG. 4 shows for one example the dependence of the mass-flow ratios (mass flow m1 of all the rotor cooling-air leakage L/mass flow m2 of the actual leakage air L2 flowing into the bearing space 16) at a divided labyrinth on the ratio of the number of sealing strips (n2/n1) or on the size ratio of the gaps (s1/s2). The mass-flow ratio m1/m2 increases with an increase in n2/n1 and s1/s2. The quantity of barrier air S (m1–m2) and its pressure can thus be changed by changing the number of sealing strips of the labyrinth seals and by changing the gap sizes.

An essential additional advantage of the solution according to the invention consists in the fact that no separate barrier-air feed from the compressor is necessary and that there is also no need for a separate extraction point for the barrier air S in the compressor.

So that the bearing space 16 is not heated excessively by the leakage air and by the heat flow from the exhaust-gas stream A through the insulation 11 and the supporting structure 10, which comprises the hub 31 and the supporting ribs 20, it is cooled (see FIG. 2). The heat entering the bearing space 16 is in the process transported to the outside through the passages 8 in the exhaust-gas diffuser 9 by ambient air which is introduced by a fan 23 through a pipe 24 reaching up to the gland 18.

The gland 18 is subdivided into two concentric annular spaces 25, 26, the annular space 25 being used for the barrier air S and the annular space 26 being used for the bearing-space cooling air K. The air is uniformly distributed at the periphery by the gland 18.

The bearing space 16 is subdivided into two spaces, in the top part by means of a hood 27 arranged between bearing housing 14 and supporting structure 10 and essentially parallel to the supporting structure 10 and in the bottom part by means of an oil drip plate 28, the requisite cooling-air quantity in the two parts of the bearing space 16 being determined via bores 29 specifically made in the gland 18 in the annular cooling-air space 26. Thus the supporting structure 10 can be cooled specifically and uniformly at the periphery. At the same time, the surroundings of the bearing housing 14 and the devices arranged inside the hood 27 are cooled separately. Furthermore, the hood has the task of preventing the radiation of heat to devices and bearing housing.

Cold air is likewise specifically introduced near the oil wipers 13 in the top and bottom part from the annular cooling-air space 26. This ensures that only cold air penetrates into the bearing body 15, in which a slight vacuum is always to prevail.

The advantages of this combined barrier and cooling system consist in the fact that safe heat dissipation is guaranteed, that uniform cooling occurs at the periphery for supporting structure, bearing body and oil wipers, that the cooling-air flows can be specifically set by selecting the size and number of the openings in the annular cooling-air space, and that cost savings are possible through the use of the combined gland.

Figure 5:
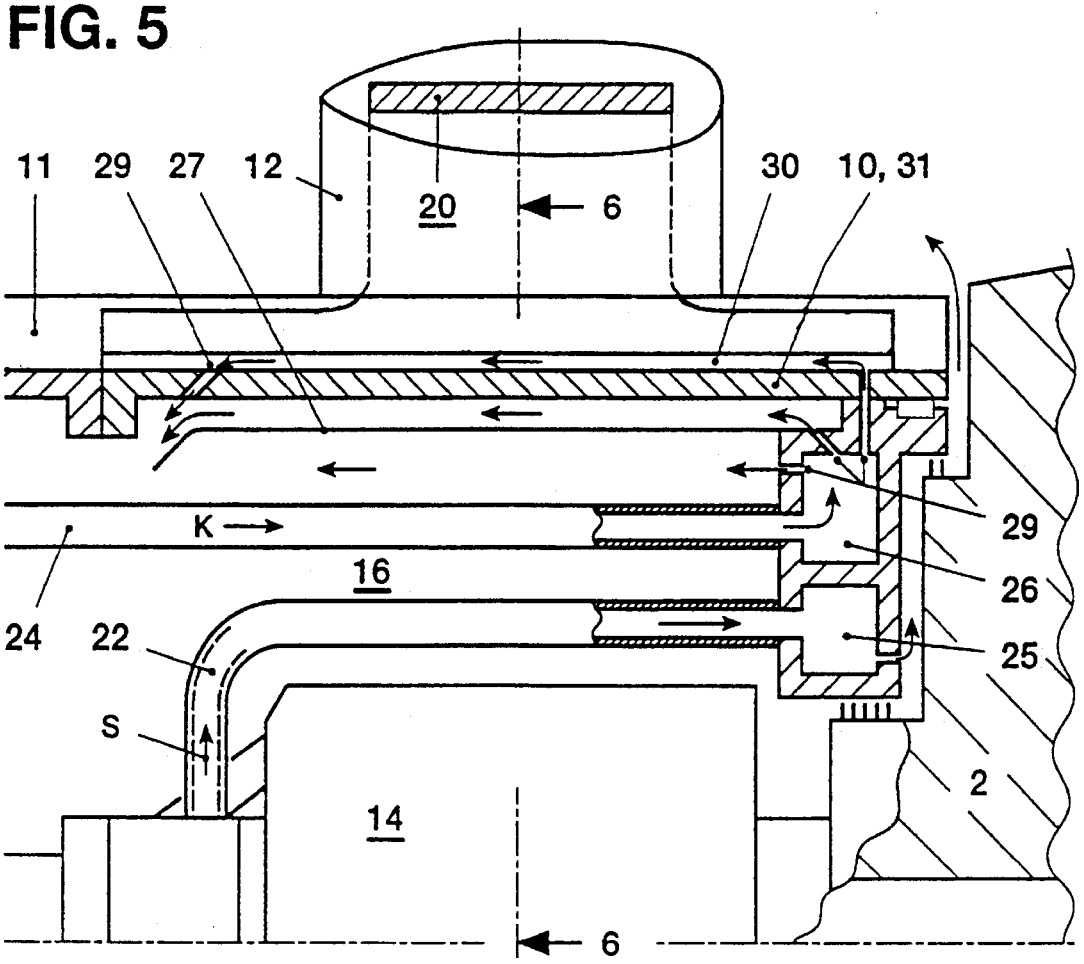
FIG. 5 shows a partial longitudinal section of the bearing area.
Figure 6:
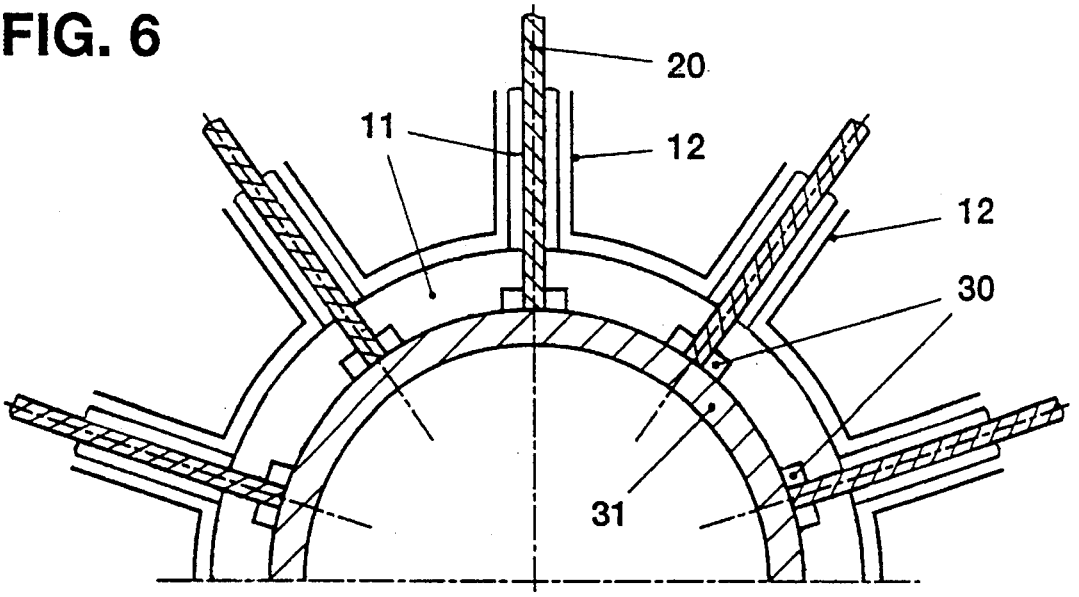
FIG. 6 shows a partial cross-section of FIG. 5 in the area of the flow ribs.

The invention is of course not restricted to the exemplary embodiment described above. A further embodiment variant of the invention is shown in FIG. 5 and FIG. 6. In addition to the exemplary embodiment described above, cooling ducts 30 are also arranged here in the supporting structure 10. These cooling ducts 30 are located at the foot of the supporting ribs 20 and are fed with air from the annular cooling-air space 26 via bores 29. The cooling ducts 30 are each preferably arranged on either side at the foot of the supporting ribs 20 and serve to dissipate the heat coming from the exhaust-gas stream before entering the hub 31 or the inner space.

With this measure, an exact heat transfer coefficient is achieved at the foot of the strut, which guarantees accurate heat dissipation or uniform temperature at all flow ribs 12. Further advantages can be seen in the fact that, through the specific use of the cooling air in the cooling ducts, air is saved and large heat transfer coefficients are achieved. In addition, a uniform temperature is achieved at the periphery of the inner casing structure, since the air flows in ducts and consequently there are no flow obstructions.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A method of shaft sealing and of cooling on the exhaust-gas side of a thermal turbomachine, the turbomachine including an outlet-side bearing arrangement of a turbine rotor, an exhaust-gas casing construction having an exhaust gas diffuser defining an exhaust-gas duct through which exhaust gas flows and inside of which the bearing arrangement is disposed, the bearing arrangement having a bearing space in flow communication with the exhaust-gas duct, through a plurality of labyrinth seals and one or more glands for preventing exhaust gas from entering the bearing space, comprising the steps of:

directing barrier air having a higher pressure than a pressure of exhaust gas in the exhaust-gas duct into the one or more glands and then into the exhaust-gas duct to seal the bearing space;

extracting rotor cooling air from a compressor stage;

feeding the rotor cooling air, via a pipeline, into the rotor;

diverting a portion of the rotor cooling air, the diverted portion of cooling air being directed by the plurality of the labyrinth seals such that at least a first portion of the diverted portion of cooling air flows through a barrier gas pipeline for use as the barrier air and a second portion of the diverted portion of cooling air flows into the bearing space;

introducing and uniformly distributing ambient air into a periphery of the bearing space via the one or more glands separately from the barrier air; and transporting the ambient air to an outside of the turbomachine through passages in the exhaust-gas diffuser.

2. The method as claimed in claim 1, wherein the labyrinth seals include first and second labyrinth seals, the first and second labyrinth sealing include first and second groups of sealing strips, respectively, the first and second groups of sealing strip being disposed in first and second passage portions, respectively, and defining first and second gap sizes therewith, respectively, the method comprising the step of changing a quantity and a pressure of the barrier air by changing at least one of a number sealing strips of the first and second groups of sealing strips, and the first and second gap sizes defined by the first and second sealing strips and the first and second passages, respectively.

3. The method as claimed in claim 1, wherein the one or more glands include an annular cooling-air space into which the ambient air is introduced and from which the ambient air is uniformly distributed for cooling supporting ribs of the turbomachine.

4. A thermal turbomachine, the turbo-machine including an outlet-side bearing arrangement of a turbine rotor;

an exhaust-gas casing construction having an exhaust gas diffuser defining an exhaust-gas duct through which exhaust gas flows, the bearing arrangement being disposed inside of the exhaust gas duct;

a bearing space of the bearing arrangement, the bearing space including a top part and a bottom part, the top part being subdivided into first and second parts by a hood and the bottom part being subdivided into first and second parts by an oil drip plate;

a pipeline for feeding rotor cooling air into the rotor;

a gap in the pipeline, a portion of the rotor cooling air being diverted into the gap and into a first passageway, the first passageway having a first labyrinth seal, the first passageway being in flow communication with a barrier gas pipeline, the barrier gas pipeline leading to a first annular portion of a gland, and with a second passageway, the second passageway having a second labyrinth seal and being in flow communication with the bearing space;

the gland having the first annular portion and a second annular portion, the first annular portion being in flow communication with the exhaust gas duct, the second annular portion being in flow communication with the first and second parts of the top and the bottom parts of the bearing space;

an ambient cooling air pipeline extending through the bearing space to the second annular space.

5. The apparatus as claimed in claim 4, wherein the exhaust gas casing includes an inner part including a supporting structure and along supporting ribs of the exhaust gas casing, the apparatus further comprising cooling ducts arranged between the supporting structure and the insulation, the cooling ducts being connected, at turbine-side inlet parts thereof, via bores to the second annular space of the gland and, at outlet parts thereof, to the bearing space.

6. The apparatus as claimed in claim 5, wherein the supporting ribs each include a foot, the cooling ducts being arranged on opposite sides of the foot of each of the supporting ribs.

* * * * *